US011731852B2

(12) United States Patent
Cavus et al.

(10) Patent No.: US 11,731,852 B2
(45) Date of Patent: Aug. 22, 2023

(54) WINDING MACHINE

(71) Applicant: Georg Sahm GmbH & Co. KG, Eschwege (DE)

(72) Inventors: Gurkan Cavus, Waldkappel (DE); Konrad Winkler, Berkatal (DE); Holger Krones, Eschwege (DE)

(73) Assignee: Georg Sahm GmbH & Co. KG, Eschwege (DE)

( * ) Notice: Subject to any disclaimer, the term of this patent is extended or adjusted under 35 U.S.C. 154(b) by 19 days.

(21) Appl. No.: 17/201,226

(22) Filed: Mar. 15, 2021

(65) Prior Publication Data

US 2021/0198078 A1 Jul. 1, 2021

Related U.S. Application Data

(63) Continuation of application No. PCT/EP2019/072030, filed on Aug. 16, 2019.

(30) Foreign Application Priority Data

Sep. 19, 2018 (EP) ..... 18195553

(51) Int. Cl.
*B65H 54/28* (2006.01)
*B65H 57/28* (2006.01)
*B65H 54/36* (2006.01)

(52) U.S. Cl.
CPC ..... *B65H 54/2827* (2013.01); *B65H 54/36* (2013.01); *B65H 57/28* (2013.01); *B65H 2701/31* (2013.01)

(58) Field of Classification Search
CPC .... B65H 54/2827; B65H 54/36; B65H 57/28; B65H 2701/31
See application file for complete search history.

(56) References Cited

U.S. PATENT DOCUMENTS 3,625,442 A 12/1971 Dimeglio
4,076,181 A 2/1978 Coggin
5,967,449 A 10/1999 Thomas
(Continued)

FOREIGN PATENT DOCUMENTS

DE 22 36 025 A1 2/1974
DE 3723593 C1 12/1988
(Continued)

OTHER PUBLICATIONS

Written Opinion for PCT/EP2019/072030 dated Oct. 15, 2019.
(Continued)

*Primary Examiner* — William E Dondero
(74) *Attorney, Agent, or Firm* — The Sladkus Law Group

(57) ABSTRACT

The invention relates to a winding machine (1). According to the invention a winding material supply guide (14) is guided for being displaced with a degree of freedom (19) relative to a frame (2) of the winding machine (1). When a winding material guiding structure (4) executes a compensating movement (23) along a degree of freedom (6) during the winding process due to an increase of the diameter of a wound package formed on a spindle (3), a corresponding movement of the winding material supply guide (14) along the degree of freedom (19) can be induced in a way such that a supply angle β of the winding material (11) to the winding material guiding structure (4) does not change during the winding process.

11 Claims, 5 Drawing Sheets

(56) References Cited

U.S. PATENT DOCUMENTS

| | | | |
|---|---|---|---|
| 7,651,046 | B2 | 1/2010 | Schmalholz |
| 10,457,518 | B2 | 10/2019 | Zaun |
| 2008/0116311 | A1 | 5/2008 | Ludwig |
| 2013/0037647 | A1 | 2/2013 | Gõrke |

FOREIGN PATENT DOCUMENTS

| | | | |
|---|---|---|---|
| EP | 1 656 317 | B1 | 12/2006 |
| EP | 1 507 730 | B1 | 2/2007 |
| EP | 1 925 580 | A1 | 5/2008 |
| EP | 3 067 304 | A1 | 9/2016 |
| JP | 08290869 | A | 5/1996 |
| RU | 2002698 | C1 | 11/1993 |
| SU | 180731 | A1 | 5/1966 |
| WO | 03/099695 | A1 | 12/2003 |

OTHER PUBLICATIONS

Opposition to co-pending Indian Application 202147017704 , Opposition dated Sep. 8, 2022.
Leesona Model 906, undated.
Lessona Model 939, dated 2005.

WINDING MACHINE

CROSS REFERENCE TO RELATED APPLICATIONS

This application is a continuation of International Application PCT/EP2019/072030 with an international filing date of Aug. 16, 2019 and claiming priority to co-pending European Patent Application No. EP 18 195 553.5 entitled "Winder", filed on Sep. 19, 2018.

FIELD OF THE INVENTION

The invention relates to a winding machine for winding a winding material to a wound package with any winding pattern. The winding process might use a sleeve or not so that the spool might only comprise the wound package or the wound package and the sleeve.

Preferably the winding machine serves for winding a winding material embodied as a "technical yarn". A technical yarn is any thread-like or tape-like or ribbon-like winding material which

- is pliable and/or
- is realized as a single filament or multifilament (for example with more than 12,000 single filaments up to 300,000 single filaments) and/or
- has a length wound to the wound package of more than 100 km (in particular more than 200 km, more than 300 km up to a length of 600 km) and/or
- has a ratio weight/length (so-called "titer") in the range of 10,000 to 20,000 den [g/9,000 m] (e.g. from 12,000 to 16,000 den) and/or
- is wound as a cross winding and/or
- is wound as a cross winding without a support of the front faces on drum discs and/or
- is wound with winding speeds of at least 10 m/min (preferably more than 30 m/min or more than 50 m/min).

BACKGROUND OF THE INVENTION

Winding machines of the present type are e.g. known from WO03/099695 A1. In this winding machine two spool spindles are supported for being rotated on a rotatable revolver. By a rotation of the revolver the spindles can be moved in an alternating fashion into a winding position and an exchange position. In the winding position the spindles can be coupled to a drive. In the winding position the winding material is wound to a wound package. A winding material guiding structure is supported for being pivoted by a pivoting arm on a frame of the winding machine. A bail roller is supported for being rotated on the pivoting arm. By the bail roller the winding material guiding structure is pressed onto an outer surface of a wound package which is wound in the winding position on the spindle. The winding material guiding structure comprises a traversing winding material guide. The traversing winding material guide is driven for executing a traversing alternating movement. Here, the traversing winding material guide executes a traversing movement having a stroke or amplitude which generally corresponds to the fanning width of the winding material, so corresponds to the axial length of the wound package (where it is e.g. possible that the axial length of the wound package is smaller than the stroke or amplitude due to the offset between the traversing winding material guide and the point where the winding material is deposited on the outer surface of the wound package). The traversing movement has an orientation parallel to the longitudinal axis and/or rotational axis of the spindle. The rotational movement of the spindle or the spool on the one hand and the traversing movement of the traversing winding material guide on the other hand are coordinated by a suitable control in a way such that a predefined winding pattern is achieved. From a winding material supply guide or winding material guiding head (in the following "winding material supply guide"; here embodied as winding material supply guide roller) the winding material is directly supplied to the traversing winding material guide and by the traversing winding material guide via the bail roller the winding material is brought into contact with the outer surface of the wound package. Due to the traversing movement of the traversing winding material guide the winding material extends within the fan angle or traversing triangle from the winding material supply guide. The length of the traversing triangle depends on the distance of the winding material supply guide arranged at the vertex of the traversing triangle from the traversing winding material guide. In the traversing triangle a traversing angle changes during the traversing movement within the maximum traversing angle $\alpha$. When the diameter of the wound package increases, the distance of the bail roller from the longitudinal axis and/or rotational axis of the spindle changes which leads to a pivoting compensating movement of the pivoting arm with the winding material guiding structure held thereon.

Another winding machine of the present type is distributed under the label "SAHM 830XE" by the applicant (cp. www.sahmwinder.de/produkte/sahm-carbon-fiber-winders/sahm-830xe.html; date of inspection Aug. 22, 2018). This winding machine does not comprise a revolver but only one single spindle which has a longitudinal axis and/or rotational axis which is fixed relative to the frame of the winding machine. For this winding machine the winding material guiding structure is not supported on a pivoting arm which is supported for being pivoted on the frame. Instead, here the compensating movement of the winding material guiding structure with the increasing diameter of the wound package is provided by guiding the winding material guiding structure for being displaced horizontally and for a translational movement on the frame of the winding machine. Also here the winding material is directly supplied from a winding material supply guide roller supported on the frame of the winding machine to the traversing winding material guide of the winding material guiding structure.

EP 1 656 317 B1 (corresponding to U.S. Pat. No. 7,651,046 B1) discloses an embodiment comprising a winding material guiding structure which is supported for being pivoted on a pivoting arm. The winding material guiding structure carries a compensation bow. The compensation bow deflects and redirects the winding material at a location arranged between the winding material supply guide and the traversing winding material guide. For this embodiment a dancer roller is arranged upstream from the winding material supply guide. The dancer roller can be deflected against the pretension of a spring. The dancer roller serves for maintaining the tension in the winding material as constant as possible. If a change of the tension in the winding material leads to a deflection of the dancer roller, this deflection is also considered by a control for an adaptation of the number of revolutions of the drive in order to maintain the predefined tension in the winding material and to achieve a constant equilibrium position of the dancer roller. For this known prior art EP 1 656 317 B1 discloses that the length of the winding material varies within the traversing triangle during the traversing movement with a high frequency corresponding to the high-frequent traversing movement which leads to an undesired change of the tension in the winding material which in some cases cannot be compensated by the dancer roller and by the adaptation of the number of revolutions of the drive of the spindle. In order to keep the change of the length of the winding material within the traversing triangle as small as possible the distance of the winding material supply guide from the winding material guiding structure is increased. However, this measure influences the constructional space requirements of the winding machine. Furthermore, EP 1 656 317 B1 discloses the finding that with the increasing diameter of the wound package and so with the simultaneous pivoting of the pivoting arm with the winding material guiding structure held thereon the length of the winding material between the winding material supply guide and the winding material guiding structure (so the length of the traversing triangle) also changes dependent on the pivoting angle of the pivoting arm. Also this effect might lead to a variation of the tension in the winding material which leads to the result that the winding material is brought into contact with the wound package with a varying tension. If the tension of the winding material varies between the edge of the wound package and the center of the wound package, according to EP 1 656 317 B1 the winding material might separate from the edge of the wound package and the winding material might be wound around a core of the spool which might lead to a required stop of the machine or which might lead to a stop of a machine or damages of the machine when using the spool during the unwinding at a later point in time. EP 1 656 317 1 proposes to arrange an additional winding material supporting means between the winding material supply guide and the deflection bow with the traversing winding material guide arranged downstream from the deflection bow. The additional winding material supporting means is held by a protruding arm at the highest possible distance from the traversing winding material guide with the deflection bow. The vertex of the traversing triangle is in this case not defined by the winding material supply guide but by the additional winding material supporting means. Due to the fact that the winding material supporting means is also pivoted when pivoting the pivoting arm and the winding material guiding structure, the length of the traversing triangle does not change with an increase of the diameter of the wound package. A supply angle of the winding material between the winding material supply guide and the additional winding material supporting means does not change and is also independent on the traversing movement. Accordingly, by the use of the winding material supporting means an undesired influence of the changing diameter of the wound package on the length of the traversing triangle is avoided. In order to avoid a change of the length of the winding material in the traversing triangle and so for avoiding oscillations of the tension in the winding material dependent on the traversing movement and on the traversing angle in the traversing triangle with the traversing movement EP 1 656 317 B1 additionally proposes the use of a curved compensating bow which is carried by the winding material guiding structure and which provides an additional deflection of the winding material at a location between the traversing winding material guide and the additional winding material supporting means. The extent of the additional deflection changes with the traversing angle in the traversing triangle changing which changes with the traversing movement. Here, the contour of the compensation bow is designed such that the length of the winding material between the winding material supporting means and the traversing winding material guide does not depend on the position of the traversing winding material guide, so does not change with a change of the traversing angle within the traversing triangle. For that purpose the winding material is deflected by a larger extent by the compensation bow when the traversing winding material guide is in the center than in the case when the traversing winding material guide is at the edge. EP 1 656 317 B1 also discloses further embodiments wherein an additional roller is supported via a protruding arm (with a strain gauge arranged therein) on the winding material guiding structure. This additional roller is arranged upstream from the winding material supporting means. In order to keep the mass and the dimension of the winding material guiding structure as small as possible, the length of the supporting arm on which the winding material supporting means is supported is defined within narrow confines so that also the length of the traversing triangle is very small. This again leads to the disadvantage that with the traversing movement the tension in the winding material changes with an undesired amount of the change or the use of a curved compensation bow is necessarily required which might be undesired due to the additional redirection which might lead to deteriorations of the winding material.

The applicant also distributes a winding machine under the label "Carbon Star 850XE" (cp. www.sahmwinder.de/produkte/sahm-carbon-fiber-winders/carbonstar-ii.html; date of inspection: Aug. 22, 2018). In this winding machine the winding material guiding structure with the traversing winding material guide is moved by a compensating movement due to the increasing diameter of the wound package with a linear movement towards the winding material supply guide. Accordingly, the compensating movement does not lead to a change of the supply angle β and of the angle under which the winding material leaves the winding material supply guide and of the angle of the supply of the winding material to the winding material guiding structure. However, for this embodiment the length of the traversing triangle reduces with the compensating movement. This reduction leads to the result that with the compensating movement the maximum traversing angle α of the traversing triangle increases so that also the extent of the required deflection of the winding material by the traversing winding material guide increases which is undesired.

Furthermore, the applicant distributes a winding machine under the label "SAHM 880XE" (cp. www.sahmwinder.de/produkte/sahm-carbon-fiber-winders/sahm-880xe.html; date of inspection: Aug. 22, 2018). In this winding machine the winding material guiding structure with the traversing winding material guide is fixedly arranged on a frame of the winding machine whereas for providing the compensating movement the spindle with the spool formed thereon is displaced. However, this solution requires (in particular for heavy spools) a very stable construction so that this embodiment is preferably only used for light-weight spools with a weight of less than 20 kg.

Further prior art is known from the publications EP 1 925 580 A1 (corresponding to US patent application US 2008/0116311 A1), U.S. Pat. No. 4,076,181 A and DE 22 36 025 A1.

SUMMARY OF THE INVENTION

The inventive winding machine comprises a frame which might also be embodied as a base plate, a rack, mount, support or housing. The winding machine comprises a spindle which might be rotatable for inducing the rotational movement of the spool during the winding process. It is also possible that the spindle cannot be rotated. In this case the spool is in particular driven for inducing the rotational movement by driving the spool body or by a frictional drive interacting with the outer surface of the wound package. The invention also covers embodiments wherein the winding machine does not comprise one single spindle but at least two spindles. Here, it is also possible that at least two spindles are held on a revolver (cp. the prior art EP 1 507 730 A1 mentioned above).

The winding machine comprises a winding material guiding structure. The winding material guiding structure comprises a traversing winding material guide which is driven for executing a traversing movement. The winding material guiding structure comprises a bail means which is pressed against an outer surface of a wound package wound on the spindle. The bail means is preferably embodied as a bail roller which is supported for being rotated on a base body of the winding material guiding structure. A bail roller of this type might only serve for supporting the winding material guiding structure on the wound package. It is also possible that the bail roller additionally serves for providing that the winding material is brought into contact with the outer surface of the wound package. Furthermore, it is possible that by means of the bail roller the density of the wound package is increased dependent on the force pressing the bail roller onto the outer surface of the wound package which leads to a harder wound package and/or allows that in the same diameter of the wound package a different length of the winding material can be stored. It is also possible that the bail roller biases the outer surface of the wound package with a bailing force which changes over the winding process. Furthermore, it is possible that the bailing force of the bail roller on the outer surface of the wound package is controlled in a way such that there is no bulging or swelling of the wound package or such that markings on the winding material at crossing points of the wound package are avoided. The winding material guiding structure (and therewith the traversing winding material guide) is movable with a compensating movement relative to the spindle corresponding to the increasing diameter of the wound package during the winding process. This is provided by the support of the bail means on the outer surface of the wound package.

The winding machine comprises a winding material supply guide. The winding material supply guide is arranged in the path of the winding material at a location upstream from the traversing winding material guide. The winding material supply guide is arranged, held and/or guided on the frame at a position remote from the winding material guiding structure. From the winding material supply guide the winding material is directly transferred or supplied to the winding material guiding structure without any deflection or redirection of the winding material on the path of the winding material between the winding material supply guide and the winding material guiding structure. The winding material supply guide defines the vertex of the fan angle or traversing triangle (in the following traversing angle).

With the novel invention it is possible to propose a winding machine which is in particular improved with respect to

- the deflection of the winding material on the path of the same to the wound package and/or
- an influence or effect of the compensating movement of the winding material guiding structure with an increase of the diameter of the wound package and/or
- an influence or effect of the traversing angle in the traversing triangle and/or
- an influence or effect of the compensating movement on the deflection of the winding material (in particular in the region of the traversing winding material guide)
- a provision that the overall traversing angle $\alpha$ does not change or does not significantly change and/or
- a reduction of oscillations of the tension in the winding material and/or
- the demands for devices as dancer rollers and/or for a control of the drive for keeping the tension in the winding material constant and/or
- the quality of the spool wound with the winding machine and/or
- the installation size of the winding material guiding structure.

The prior art based on the prejudice that it is required to fix the winding material supply guide on the frame of the winding machine whereas the measures for influencing the path and for deflecting the winding material (in particular on the one hand for providing the compensating movement and on the other hand for providing the traversing movement within the traversing triangle) have exclusively been taken at the winding material guiding structure.

The invention (alternatively or cumulatively to the known measures that can be taken at the winding material guiding structure) for the first time proposes that the winding material supply guide is held and guided for being moved on the frame of the winding machine. Here, within the frame of the invention the winding material supply guide is moved dependent on the compensating movement of the winding material guiding structure with the change of the diameter of the wound package. The movement of the winding material supply guide at least reduces effects of the compensating movement on the path of the winding material between the winding material supply guide and the traversing winding material guide. In particular, according to the invention a change of the exit angle of the winding material when exiting from the winding material supply guide and/or a change of the deflection angle of the winding material at the winding material supply guide and/or a change of the supply angle of the winding material at the entry into the winding material guiding structure and/or a change of the deflection angle of the winding material at the winding material guiding structure (here in particular at the traversing winding material guide) which depends on the compensating movement is reduced or completely eliminated.

Generally, there might be any type of movement of the winding material supply guide. In order to mention only some examples (which are not intended to limit the invention) the winding material supply guide might be guided by a translational guide, a curved guide or a guide along an arc of a cycle relative to the frame. These variants might be both used in the case that the winding material guiding structure is guided for a translational movement relative to the frame as well as in the case that the winding material guiding structure is guided for executing a pivoting movement relative to the frame (e.g. by use of a pivoting arm). Here, the winding material supply guide preferably moves in a way such that with respect to the direction and/or the moving distance the movement corresponds to the compensating movement of the winding material guiding structure or approximates the same. For a particular proposal the winding material supply guide is moved in a way such that the supply angle $\beta$ of the winding material at the entry into the winding material guiding structure in a plane having an orientation transverse to the traversing axis of the traversing winding material guide does not change (which also covers a change of the supply angle β of +/−5.0° or +/−2.0° or +/−1.0° or +/−0.5°).

The movement of the winding material supply guide can be induced in a lot of different ways. For one variant the winding material supply guide can be moved by an actuator. Here, the movement controlled by the actuator depends on the compensating movement. In order to mention only some examples (which are not intended to limit the present invention) the diameter of the wound package might be directly or indirectly sensed by a sensor. The sensor might e.g. sense the diameter of the wound package by a measurement of a displacement, by a sensing wheel and the like. It is also possible that the diameter of the wound package is indirectly sensed by measuring a movement of the winding material guiding structure due to the compensating movement. The diameter of the wound package can also be indirectly sensed by measuring a length of the wound winding material. It is then possible to calculate the diameter of the wound package from the measured length. In order to mention another example, indirectly the diameter of the wound package can be determined from the extent of the movement of the traversing winding material guide (in particular the number of executed strokes). Another option for determining the diameter of the wound package is the calculation of the same from the rotational number of the spindle and/or the velocity of the winding material. It is e.g. possible to calculate the length of the winding material which has been wound to the wound package from the integral of the velocity of the winding material (which can be calculated from the curve of the number of revolutions of the spindle). From the length of the winding material then on the basis of a characteristic map or a functional dependency the diameter of the wound package can be determined. If then a corresponding signal for the actual diameter of the wound package is present, by means of a control unit the actuator can be controlled which then moves the winding material supply guide by the required extent.

A notably simple but reliable option for inducing the movement of the winding material supply guide is provided by mechanically coupling the compensating movement of the winding material guiding structure to the movement of the winding material supply guide so that passive measures are taken. In the simplest case the winding material guiding structure is mechanically coupled by a coupling means (as e.g. a coupling strut or in some cases also a connection via a transmission) to the winding material supply guide so that the compensating movement of the winding material guiding structure is transmitted or transformed by the kinematic of the coupling strut or by the transmission arranged between the winding material supply guide and the winding material guiding structure into the movement of the winding material supply guide.

Any traversing winding material guide might be used in the winding material guiding structure as these are e. g. known from the different embodiments of the prior art. Preferably, in the winding machine a traversing winding material guide is used which guides and/or deflects the winding material by use of a sliding contact.

Within the frame of the invention there are a lot of options for the length of the winding material between the winding material supply guide and the traversing guiding material guide. For one proposal this length is at least 300 mm (e.g. more than 350 mm, more than 400 mm, more than 450 mm, more than 500 mm or even more than 600 mm). A choice of one of these lengths leads to a traversing triangle having a corresponding length. Accordingly, a change of the length of the winding material between the winding material supply guide and the traversing winding material guide (which might lead to a changed tension of the winding material) is comparatively small so that in some cases a use of a compensating bow is not required. On the other hand, such a length of the winding material between the winding material supply guide and the traversing winding material guide also reduces a deflection angle of the winding material at the traversing winding material guide which reduces the bias of the winding material.

Generally (as mentioned above) on the one hand the winding material supply guide and on the other hand the winding material guiding structure might have any degrees of freedom. For one proposal both the winding material guiding structure and the winding material supply guide are guided with a translational degree of freedom. Here, the translational degrees of freedom of the winding material guiding structure and of the winding material supply guide have an orientation parallel to each other. The winding material guiding structure and the winding material supply guide preferably move synchronously with the same amplitudes along the parallel degrees of freedom. It is e.g. possible that the winding material supply guide is arranged in a lower end region of the winding machine and the winding material supply guide is guided by a guide for a translational movement in horizontal direction. In this case the winding material guiding structure can be arranged in an upper end region of a frame of the winding machine with a translational degree of freedom also having an orientation in horizontal direction. In this way, for small constructional dimensions of the winding machine nevertheless a large length of the winding material between the winding material supply guide and the traversing winding material guide can be provided with the related advantages explained above.

Advantageous developments of the invention result from the claims, the description and the drawings. The advantages of features and of combinations of a plurality of features mentioned at the beginning of the description only serve as examples and may be used alternatively or cumulatively without the necessity of embodiments according to the invention having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the invention or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the invention do not have the features mentioned in the claims.

The number of the features mentioned in the claims and in the description is to be understood to cover this exact number and a greater number than the mentioned number without having to explicitly use the adverb "at least". For example, if an element is mentioned, this is to be understood such that there is exactly one element or there are two elements or more elements. Additional features may be added to these features, or these features may be the only features of the respective product.

The reference signs contained in the claims are not limiting the extent of the matter protected by the claims. Their sole function is to make the claims easier to understand.

BRIEF DESCRIPTION OF THE DRAWINGS

In the following, the invention is further explained and described with respect to preferred exemplary embodiments illustrated in the drawings.

DETAILED DESCRIPTION

Figure 1:
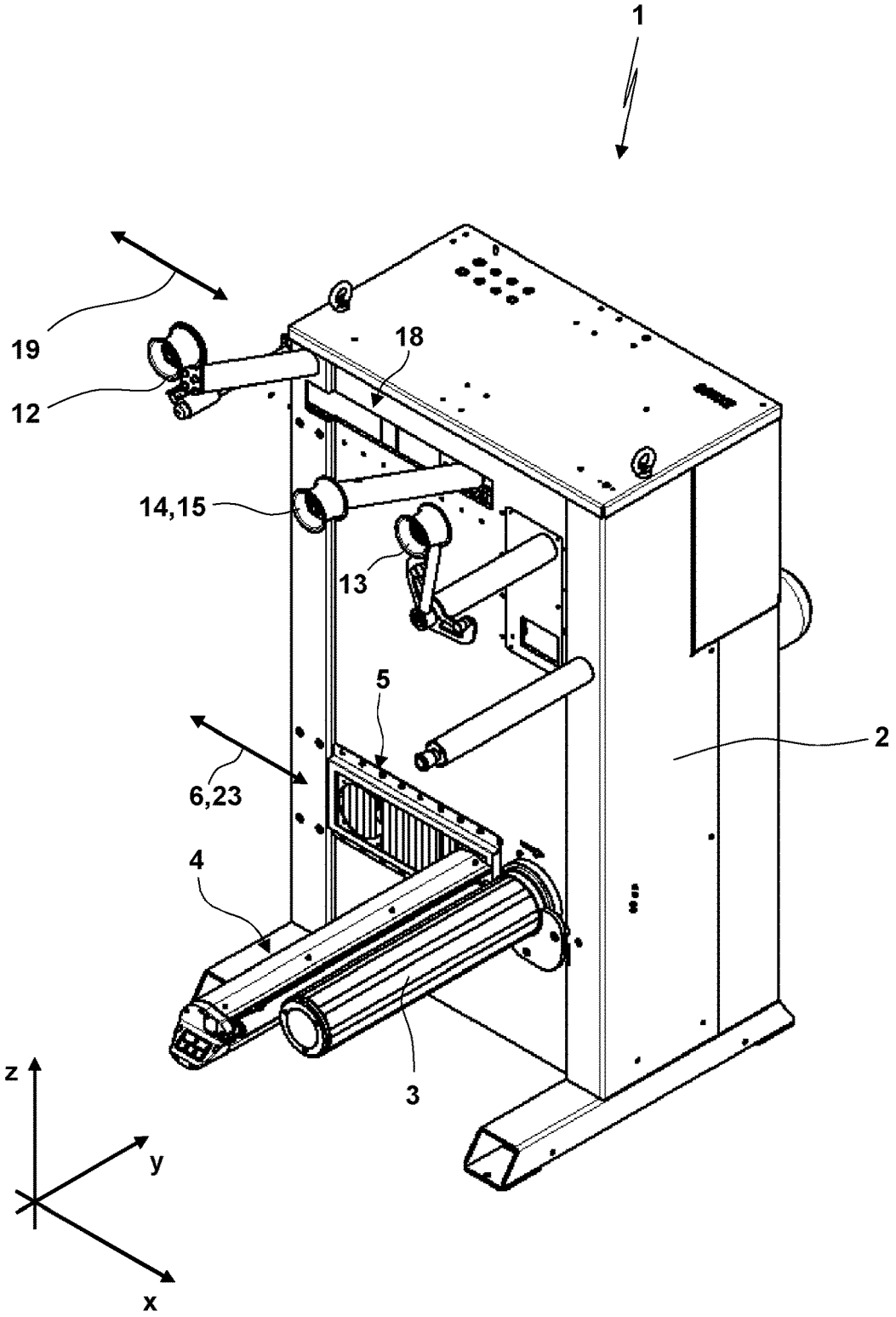
FIG. 1 in a three-dimensional view shows a winding machine for a viewing direction from the front and from above.

FIG. 1 in a three-dimensional view shows a winding machine 1. The winding machine 1 comprises a frame 2 which might be embodied as a cover plate, a housing, a rack and the like. The essential, components of the winding machine 1 listed in the following are held and/or guided on the frame 2.

The winding machine 1 comprises a rotating spindle 3 which is here arranged at a fixed location which has an orientation parallel to an y-axis. A winding material guiding structure 4 extends parallel to the spindle 3 and along the y-axis. The winding material guiding structure 4 is supported by a guide 5 (which here defines a horizontal degree of freedom 6) for being moved on the frame 2. The winding material guiding structure 4 comprises a bail means 7, here a bail roller 8. The bail roller 8 is supported for being rotated parallel to the y-axis on a base body of the winding material guiding structure 4. By a suitable actuator (not shown here) or a weight the winding material guiding structure 4 is biased along the degree of freedom 6 towards the spindle 3 so that the winding material guiding structure 4 is supported via the bail roller 8 with a predefined bailing force on the outer surface of a wound package generated on the spindle 3. The winding material guiding structure 4 comprises a traversing winding material guide 9 which can be moved with a traversing movement 10 bidirectionally parallel to the y-axis.

Figure 4:
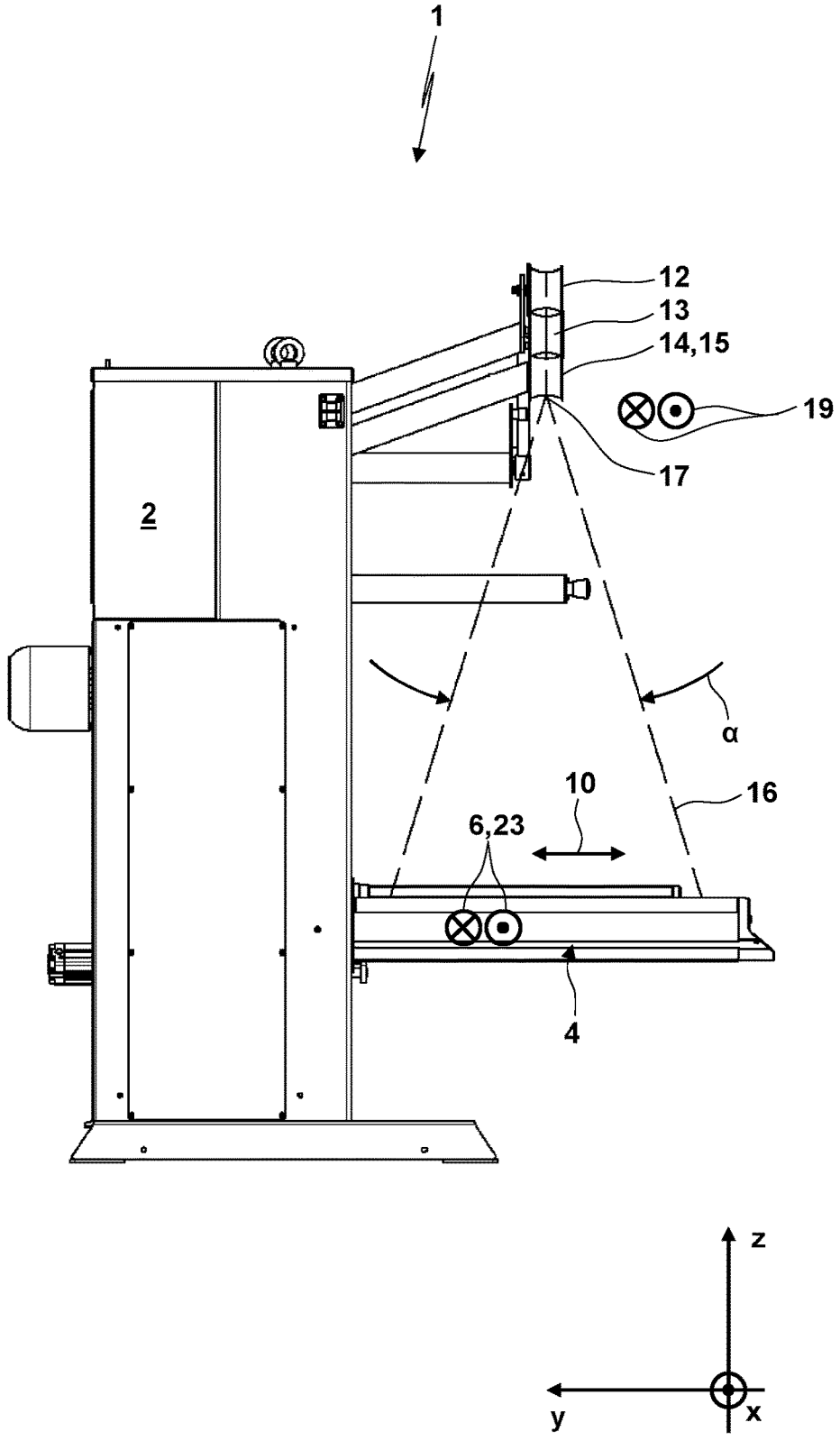
FIG. 4 shows the winding machine of FIGS. 1 to 3 in a side view.

A winding material 11 is e.g. supplied by a continuous or discontinuous production process and supplied to the winding material guiding structure 4, here the traversing winding material guide 9, via a first roller 12, a deflection roller 13, a winding material supply guide 14 (here embodied as winding material supply guide roller 15). No other guiding element which guides or deflects the winding material 11 is arranged between the winding material supply guide 14 and the winding material guiding structure 4. A traversing triangle 16 with an overall traversing angle $\alpha$ is formed between the winding material supply guide 14 and the winding material guiding structure 4 (cp. FIG. 4). The winding material supply guide 14 defines the vertex 17 of the traversing triangle 16. The length of the traversing triangle 16 corresponds to the distance 22 of the winding material supply guide 14 from the traversing winding material guide 9. The winding material supply guide 14 is guided by a guide 18 with a (here translational and horizontal) degree of freedom 19 relative to the frame 2.

In the figures an x-axis denotes a horizontal direction which for the shown embodiment has an orientation parallel to the degrees of freedom 6, 19. The y-axis has an orientation parallel to the longitudinal axis and/or the rotational axis of the spindle 4. Furthermore, the winding material guiding structure 4 extends along the y-axis. The traversing movement 10 of the traversing winding material guide 9 has an orientation parallel to the y-axis. The bail roller 8 rotates about the y-axis. Finally, a z-axis defines a vertical axis of the winding machine 1. A supply angle $\beta$ denotes the angle of the winding material in the x-z-plane relative to the z-plane.

Figure 2:
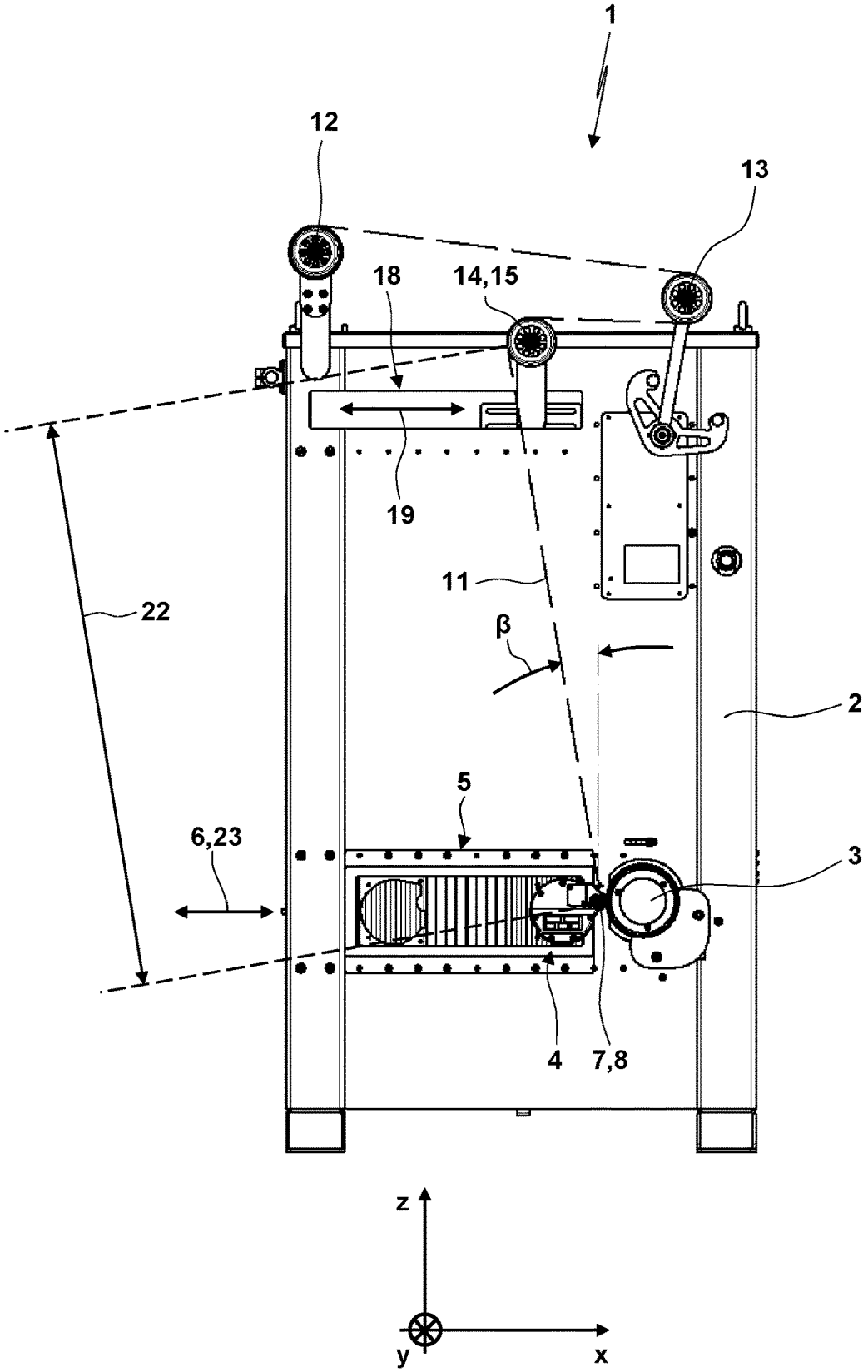
FIG. 2 shows the winding machine of FIG. 1 in a front view.

FIG. 2 shows the winding machine at the start of the winding process (so at the beginning of the winding of the wound package on the spindle 3). At the start of the winding process the winding material guiding structure 4 is in a position along the degree of freedom 6 having the smallest radial distance from the longitudinal axis and rotational axis of the spindle 3. During the winding process the diameter of the wound package increases which leads to the result that the winding material guiding structure 4 moves with a compensating movement 23 along the degree of freedom 6 more and more away from the longitudinal and/or rotational axis of the spindle 3. If (differing from the inventive embodiment) the winding material supply guide 14 was arranged at a fixed location on the frame 2, this compensating movement 23 of the winding material guiding structure 4 had the result that the supply angle $\beta$ changes (for the shown embodiment: reduces) which is undesired. A movement of the winding material supply guide 14 along the degree of freedom 19 is induced. The extent of the movement of the winding material supply guide 14 corresponds to the extent of the movement of the winding material guiding structure 4. By this measure it is possible to keep the supply angle $\beta$ constant during the winding process independent on the diameter of the wound package and on the compensating movement 23. Accordingly, the geometry (in particular the length) of the traversing triangle 16 between the winding material supply guide 14 and the winding material guiding structure 4 does not change dependent on the compensating movement 23.

Figure 3:
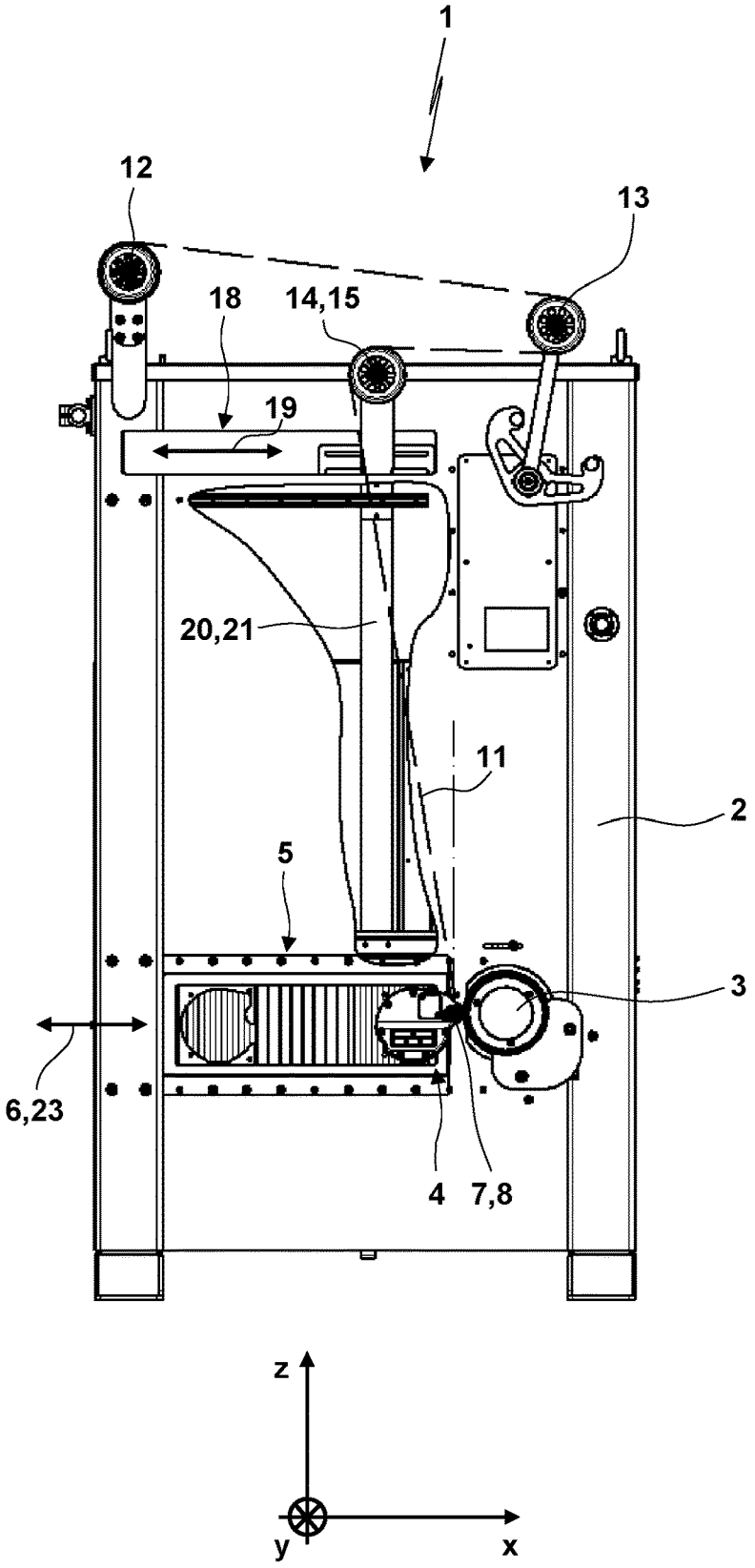
FIG. 3 shows the winding machine of FIGS. 1 and 2 in a front view where here a frame is shown in a partial sectional view so that a coupling strut between a winding material guiding structure and a winding material supply guide is visible.

For the shown embodiment the coupling of the movement of the winding material guiding structure 4 to the movement of the winding material supply guide 14 is provided by a mechanical coupling means 20 which is here embodied as coupling strut 21 which rigidly connects the winding material guiding structure 4 to the winding material supply guide 14 (cp. FIG. 3). Here, the coupling strut preferably extends within the frame or housing 2 so that the coupling strut 21 is not visible from the outside and covered by the housing wall.

Figure 5:
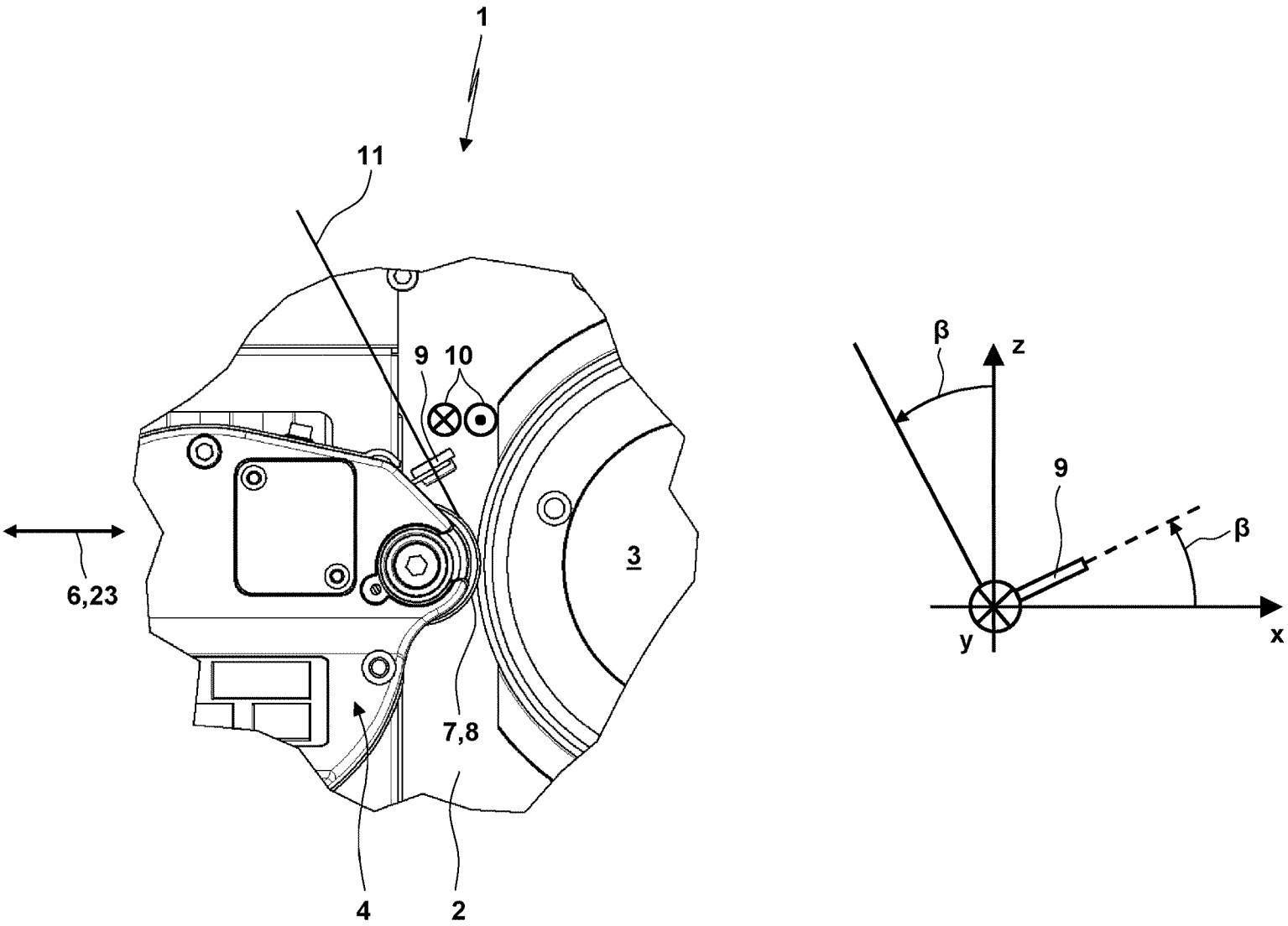
FIG. 5 shows a detail of a front view of the winding machine of FIGS. 1 to 4 in the contact region between the winding material guiding structure and a wound package.

As can be seen in FIG. 5 for one possible embodiment the traversing winding material guide 9 has a plate-like design. In this case the traversing winding material guide 9 comprises a (e.g. U-shaped) recess through which the winding material 11 extends. In the center of the traversing triangle 16 the winding material 1 extends through the U-shaped recess without any deflection of the winding material. Instead, for any offset from the center position there is a deflection by one of the side legs of the U of the traversing winding material guide 9 and with an increasing distance from the centered position there is a larger deflection by this side leg of the U. The here plate-shaped traversing winding material guide 9 has an orientation vertical to the supply direction of the winding material 11. Accordingly, the traversing winding material guide 9 and the extensional plane of the U-shaped recess are also inclined by the supply angle β relative to the x-y-plane.

The present embodiment in particular leads to the following (alternative or cumulative) differences and advantages when compared to the solutions known from the prior art having a winding material supply guide 14 with a fixed location:

a) Due to the fact that the supply angle β does not change the contact conditions of the winding material 11 and the winding material supply guide 14 are independent on the compensating movement 23 and on the diameter of the wound package of the coil.

b) In the case that the winding material supply guide 14 is embodied as a winding material supply guide roller 15, the design has the consequence that the angle of deflection by the winding material supply guide roller 15 does not change with the compensating movement 23 or changes only with a reduced extent. (The angle of deflection in particular does not change dependent on the compensating movement 23 if the winding material 11 is supplied parallel to the compensating movement 23 to the winding material supply guide roller 15 whereas for a different supply direction of the winding material 11 to the winding material supply guide roller 15 a change of the angle of deflection might result dependent on the compensating movement 23.)

c) Furthermore, the supply conditions of the winding material 11 at the entry into the winding material guiding structure 4 and in particular at the entry into the traversing winding material guide 9 do not depend on the compensating movement 23 and so on the diameter of the wound package being wound. It is e.g. possible that by the given measures it is avoided that due to a changing supply angle β the winding material 11 is pulled stronger into the base of the U-shaped recess of the traversing winding material guide 9 (increase of the supply angle β) so that then also an angle of deflection of the winding material 11 at the U-shaped recess of the traversing winding material guide 9 would be increased. By the given measures it is also possible to avoid that due to a reduced supply angle β at the entry of the winding material 11 into the traversing winding material guide 9 the winding material 11 is slightly pulled in upper direction with a changed angle out of the side legs of the U-shaped recess.

d) The distance 22 of the winding material supply guide 14 from the traversing winding material guide 9 (cp. FIG. 2) is at least 300 mm. By use of the comparatively large distance of the winding material supply guide 14 from the traversing winding material guide 9 the length of the winding material 11 between the winding material supply guide 14 and the traversing winding material guide 9 does only change to a small extent during one stroke of the traversing movement 10 so that in some cases compensating measures 23 as the use of a compensating bow are dispensable. Here, the distance 22 correlates with the length of the traversing triangle 16.

e) A deterioration of the quality of the winding material 11 due to changed contact conditions of the winding material 11 over the winding process is reduced or avoided and the spool quality is improved over winding machines wherein a supply angle β changes over the winding process with an in some cases resulting change of the overall traversing angle α of the traversing triangle 16.

f) In some cases also a traversing winding material guide 9 might be used which is not entangled by the winding material 11. In this traversing winding material guide 9 the winding material might only be guided parallel to the longitudinal axis and/or rotational axis of the spindle 3. For this embodiment the winding material 11 is treated with care due to a reduced bending bias because there is no deflection.

The invention covers both embodiments wherein the movement of the winding material supply guide 14 only depends on the compensating movement 23 of the winding material guiding structure 4 as well as embodiments wherein the movement of the winding material supply guide 14 also depends on at least another operation parameter additional to the dependency on the compensating movement 23 of the winding material guiding structure 4.

Furthermore, the invention covers embodiments wherein the movement of the winding material supply guide 14 is not coupled over the whole stroke but only over a part of the stroke of the compensating movement 23 to the movement of the winding material guiding structure 4. A coupling of the movement of the winding material supply guide 14 to the movement of the winding material guiding structure 4 might also be embodied with any linear or non-linear dependency.

Furthermore, the invention covers embodiments wherein a movement of the winding material supply guide 14 is not only dependent on the movement of the winding material guiding structure 4 but might additionally also be induced for other purposes. It is e.g. possible that in the case that the winding material supply guide 14 is moved by an actuator the movement of the winding material supply guide 14 is also used for at least temporarily controlling the tension of the winding material 11. In order to mention only one other example (which is not intended to limit the present invention) the winding material supply guide 14 can be moved at the start of the winding process, at the end of the winding process or for exchanging the spool for e.g. assisting the catching or cutting of the winding material 11 or for allowing the same or for inducing a configuration of the winding machine 1 which is advantageous for this particular operational state.

Many variations and modifications may be made to the preferred embodiments of the invention without departing substantially from the spirit and principles of the invention. All such modifications and variations are intended to be included herein within the scope of the present invention, as defined by the following claims.

We claim:

1. A winding machine comprising a) a frame, b) a spindle, c) a winding material guiding structure which ca) comprises a traversing winding material guide which is driven for executing a traversing movement, cb) comprises a bail means which is pressed against an outer surface of a wound package wound on the spindle and cc) is moved during a winding process according to an increasing diameter of the wound package for providing a compensating movement relative to the spindle, d) a winding material supply guide arranged upstream from the traversing winding material guide, the winding material supply guide being located at a position of the frame remote from the winding material guiding structure and a winding material being transferred directly from the winding material supply guide to the winding material guiding structure, e) the winding material supply guide being moveable in a translational manner dependent on the compensating movement, f) wherein the movement of the winding material guiding structure during the winding process is coupled to the movement of the winding material supply guide by a coupling structure which rigidly couples the winding material guiding structure to the winding material supply guide, and g) wherein the coupling structure extends within the frame such that the coupling structure is not visible from the outside and is covered by a wall of the frame.

2. The winding machine of claim 1, wherein the movement of the winding material supply guide is such that a supply angle β of the winding material into the winding material guiding structure does not change in a plane (x-z-plane) having an orientation transvers to a traversing axis of the traversing winding material guide.

3. The winding machine of claim 1, wherein it is possible to move the winding material supply guide by an actuator dependent on the compensating movement.

4. The winding machine of claim 1, wherein the traversing winding material guide guides and/or redirects the winding material by a sliding contact.

5. The winding machine of claim 1, wherein the length of the winding material between the winding material supply guide and the traversing winding material guide is at least 300 mm.

6. The winding machine of claim 1, wherein the winding material guiding structure and the winding material supply guide are each guided for a translational movement relative to the frame with parallel degrees of freedom.

7. The winding machine of claim 1, wherein the winding material supply guide is a winding material supply guide roller and no additional guiding element is arranged between the winding material supply guide roller and the traversing winding material guide.

8. The winding machine of claim 1, wherein the winding material guiding structure and the winding material supply guide are moved along translational parallel degrees of freedom.

9. The winding machine of claim 1, wherein the spindle has a fixed rotational axis.

10. The winding machine of claim 1, wherein the winding material supply guide is a winding material supply guide roller and no additional guiding element is arranged between the winding material supply guide roller and the traversing winding material guide, wherein the movement of the winding material guiding structure during the winding process is coupled to the movement of the winding material supply guide by a coupling structure which rigidly couples the winding material guiding structure to the winding material supply guide, the coupling structure extending within the frame such that the coupling structure is not visible from the outside and is covered by a wall of the frame, wherein the winding material guiding structure and the winding material supply guide are moved along translational parallel degrees of freedom, and wherein the spindle has a fixed rotational axis.

11. A winding machine comprising a) a frame, b) a spindle, c) a winding material guiding structure which ca) comprises a traversing winding material guide which is driven for executing a traversing movement, cb) comprises a bail means which is pressed against an outer surface of a wound package wound on the spindle and cc) is moved during a winding process according to an increasing diameter of the wound package for providing a compensating movement relative to the spindle, d) a winding material supply guide arranged upstream from the traversing winding material guide, the winding material supply guide being located at a position of the frame remote from the winding material guiding structure and a winding material being transferred directly from the winding material supply guide to the winding material guiding structure, wherein the winding material supply guide is a winding material supply guide roller and no additional guiding element is arranged between the winding material supply guide roller and the traversing winding material guide, e) the winding material supply guide being moveable in a translational manner dependent on the compensating movement, f) wherein the movement of the winding material guiding structure during the winding process is coupled to the movement of the winding material supply guide by a coupling structure which rigidly couples the winding material guiding structure to the winding material supply guide, the coupling structure extending within the frame such that the coupling structure is not visible from the outside and is covered by a wall of the frame, wherein the winding material guiding structure and the winding material supply guide are moved along translational parallel degrees of freedom, and wherein the spindle has a fixed rotational axis.

* * * * *